US009482475B2

(12) United States Patent
Fujisawa et al.

(10) Patent No.: US 9,482,475 B2
(45) Date of Patent: Nov. 1, 2016

(54) HEAT EXCHANGER

(75) Inventors: Takeshi Fujisawa, Yokohama (JP); Nobuo Yamaga, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 1097 days.

(21) Appl. No.: 12/954,805

(22) Filed: Nov. 26, 2010

(65) Prior Publication Data

US 2011/0155357 A1 Jun. 30, 2011

(30) Foreign Application Priority Data

Nov. 27, 2009 (JP) ..... 2009-270362

(51) Int. Cl.
*F28F 9/00* (2006.01)

(52) U.S. Cl.
CPC ..... *F28F 9/00* (2013.01); *F28F 2265/10* (2013.01)

(58) Field of Classification Search
CPC .... F28F 19/00; F28F 9/0229; F28F 2265/10; F22B 37/226; F22B 37/24; F22B 37/228; G21C 13/032; G21C 13/036; G21C 13/04
USPC ..... 165/134.1, 159, 172, 173
See application file for complete search history.

(56) References Cited

U.S. PATENT DOCUMENTS 3,704,690 A 12/1972 Mevenkamp
3,806,698 A * 4/1974 Hare et al. ..... 219/383
3,822,741 A 7/1974 Lippitsch
4,158,387 A * 6/1979 McDonald ..... 165/71
4,173,615 A * 11/1979 Otsuka et al. ..... 422/606
4,300,913 A * 11/1981 Egert et al. ..... 48/67
5,443,654 A * 8/1995 Hiltunen ..... F28G 7/00 134/16
5,653,282 A * 8/1997 Hackemesser et al. ... 165/134.1
6,767,007 B2 * 7/2004 Luman ..... 261/76
2011/0127023 A1 * 6/2011 Taras et al. ..... 165/173

FOREIGN PATENT DOCUMENTS

| | | |
|---|---|---|
| JP | 56-157789 | 12/1981 |
| JP | 60-149585 | 10/1985 |
| JP | 6-65781 | 9/1994 |
| JP | 10-9446 | 1/1998 |
| JP | 2006-125950 | 5/2006 |

OTHER PUBLICATIONS

Extended Search Report issued Nov. 13, 2013 in European Patent Application No. 10192702.8.

* cited by examiner

*Primary Examiner* — Tho V Duong
(74) *Attorney, Agent, or Firm* — Oblon, McClelland, Maier & Neustadt, L.L.P.

(57) ABSTRACT

A heat exchanger includes a shell; a pair of tube plates provided at both ends of the shell; a plurality of heat transfer tubes supported by the tube plates and housed in the shell; and a high-temperature fluid inlet connection for introducing a high-temperature fluid into the shell. A cooling jacket having a porous structure, over which a cooling fluid is to be spread, is provided on the interior surface of the high-temperature fluid inlet connection.

3 Claims, 3 Drawing Sheets

HEAT EXCHANGER

FIELD

Embodiments described herein relate generally to a heat exchanger for use in a nuclear power plant or a thermal power plant.

BACKGROUND

FIG. 6 is a cross-sectional diagram of a heat exchanger for use in a power plant, illustrating a joint portion between the main body of the heat exchanger and a high-temperature pipe for heating steam. In FIG. 6, reference numeral 60 denotes the shell of the heat exchanger. A large number of heat transfer tubes 61, supported by a pair of tube plates 62, are housed in the shell 60. A low-temperature fluid flows through the heat transfer tubes 61. A high-pressure, high-temperature fluid is introduced from a high-temperature fluid inlet connection 63 into the shell 60. Heat exchange takes place between the high-temperature fluid and the low-temperature fluid flowing through the heat transfer tubes 61.

In such a heat exchanger, a thermal stress acts on a region around the joint between the high-temperature fluid inlet connection 63 and the shell 60. This is because the high-temperature fluid inlet connection 63 thermally expands by exposure to a high temperature while the shell 60 is kept at a low temperature, and therefore the joint between the high-temperature fluid inlet connection 63 and the shell 60 is subject to a high compressive stress due to simultaneous occurrence of expansion and contraction at the joint. It is, therefore, conventional practice to employ a thermal sleeve structure in the high-temperature fluid inlet connection 63 to reduce thermal stress.

The above prior art techniques employ a thermal sleeve structure to reduce thermal stress and, in cases where the stress reducing effect is insufficient, provide an insulating means in the thermal sleeve structure to enhance the effect of reducing thermal stress.

DETAILED DESCRIPTION

Embodiments of the present invention will now be described with reference to the drawings.

A heat exchanger according to the embodiment includes a shell; a pair of tube plates provided at both ends of the shell; a plurality of heat transfer tubes supported by the tube plates and housed in the shell; and a high-temperature fluid inlet connection for introducing a high-temperature fluid into the shell. A cooling jacket having a porous structure, over which a cooling fluid is to be spread, is provided on the interior surface of the high-temperature fluid inlet connection.

Figure 1:
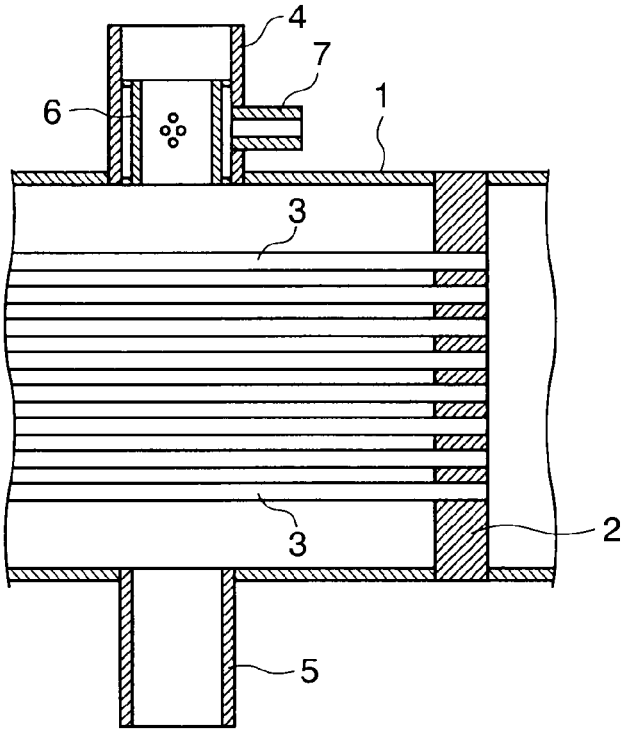
FIG. 1 is a cross-sectional view of a heat exchanger according to a first embodiment of the present invention.

FIG. 1 shows a heat exchanger according to a first embodiment of the present invention. The heat exchanger is for use in a nuclear power plant or a thermal power plant. In FIG. 1, reference numeral 1 denotes a shell constituting the main body of the heat exchanger. A tube plate 2 is mounted at each end of the shell 1. A large number of heat transfer tubes 3 are supported by the tube plates 2 in the shell 1.

A high-temperature fluid inlet connection 4 is mounted to the shell 1. A high-temperature fluid, which has been fed through not-shown high-temperature piping, is introduced from the high-temperature fluid inlet connection 4 into the shell 1. On the other hand, a low-temperature fluid flows through the heat transfer tubes 3. Heat exchange takes place between the high-temperature fluid introduced into the shell 1 and the low-temperature fluid flowing through the heat transfer tubes 3. The fluid whose temperature has been lowered by the heat exchange is discharged from a fluid outlet connection 5 provided in the shell 1.

In the heat exchanger of this embodiment, a cooling jacket 6 is mounted on the interior surface of the high-temperature fluid inlet connection 4. The cooling jacket 6 is a cylindrical member having a porous structure with numerous through-holes. The cooling jacket 6 is fit in the high-temperature fluid inlet connection 4 such that a gap which allows fluid to flow is formed between the outer surface of the cooling jacket 6 and the interior surface of the seat 4. The lower end of the cooling jacket 6 extends to the joint between the shell 1 and the high-temperature fluid inlet connection 4. To the high-temperature fluid inlet connection 4 is mounted a cooling fluid inlet port 7 for introducing a cooling fluid into the cooling jacket 6. A not-shown cooling pipe is connected to the cooling fluid inlet port 7.

The operation of the heat exchanger of this embodiment, having the above construction, will now be described.

The high-pressure, high-temperature fluid flows from the high-temperature fluid inlet connection 4 into the shell 1. The high-temperature fluid inlet connection 4 thermally expands due to its exposure to the high-temperature fluid. On the other hand, the temperature of the shell 1 is relatively low because of heat exchange taking place within the shell 1 between the low-temperature fluid flowing through the large number of heat transfer tubes 3 and the high-temperature fluid.

Under such thermal conditions, the cooling fluid is introduced from the cooling fluid inlet port 7 into the cooling jacket 6 provided in the high-temperature fluid inlet connection 4. Because the cooling jacket 6 has a porous structure with numerous through-holes, the cooling fluid is spouted out by way of the through-holes so as to be covered with the cooling fluid, whereby a increase of the temperature of the interior surface of the high-temperature fluid inlet connection 4, which is in contact with the cooling jacket 6, can be controlled.

This can reduce the temperature difference between the high-temperature fluid inlet connection 4 and the shell 1 at the joint between them, thereby reducing thermal stress. Furthermore, unlike the conventional thermal sleeve structure that reduces thermal stress mechanically, the cooling jacket 6 can sufficiently respond to the recent movement toward higher temperature of the high-temperature fluid, making it possible to enhance the structural soundness and the reliability of the heat exchanger.

Figure 2:
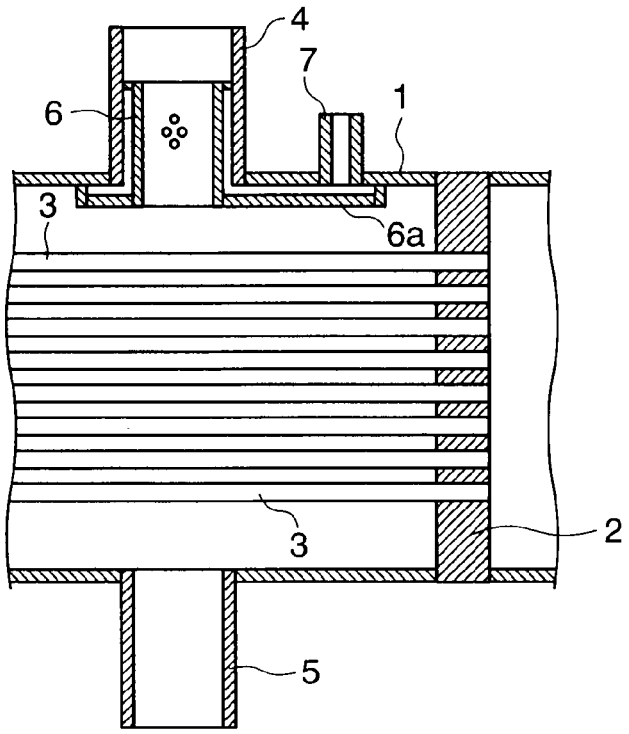
FIG. 2 is a cross-sectional view of a variation of the heat exchanger according to the first embodiment of the present invention.

FIG. 2 shows a variation of the heat changer of this embodiment. In the variation, the cooling fluid inlet port 7 for introducing a cooling fluid into the cooling jacket 6 is mounted to the shell 1. The cooling jacket 6 has an extension portion 6*a*, extending along the interior surface of the shell 1 and reaching to the cooling fluid inlet port 7, so that the cooling fluid, introduced from the cooling fluid inlet port 7, passes through the extension portion 6*a* and spreads over the entire cooling jacket 6. The other construction of the heat exchanger is the same as the embodiment shown in FIG. 1, and hence the same reference numerals are used for the same components and a detailed description thereof is omitted.

According to the embodiment of FIG. 2, the cooling fluid is supplied to the cooling jacket 6 from the cooling fluid inlet port 7 provided in the shell 1. Therefore, a wider area of the heat exchanger, including the joint between the high-temperature fluid inlet connection 4 and the shell 1, can be cooled with the cooling fluid. This can achieve a higher thermal stress reducing effect.

Though in the embodiments of FIGS. 1 and 2 the cooling fluid is supplied to the cooling jacket 6 from the not-shown cooling pipe, it is also possible to recycle the fluid, whose temperature has been lowered by the heat exchange within the shell 1 and which has been discharged from the shell 1 through the fluid outlet connection 5, to the cooling fluid inlet port 7.

Figure 3:
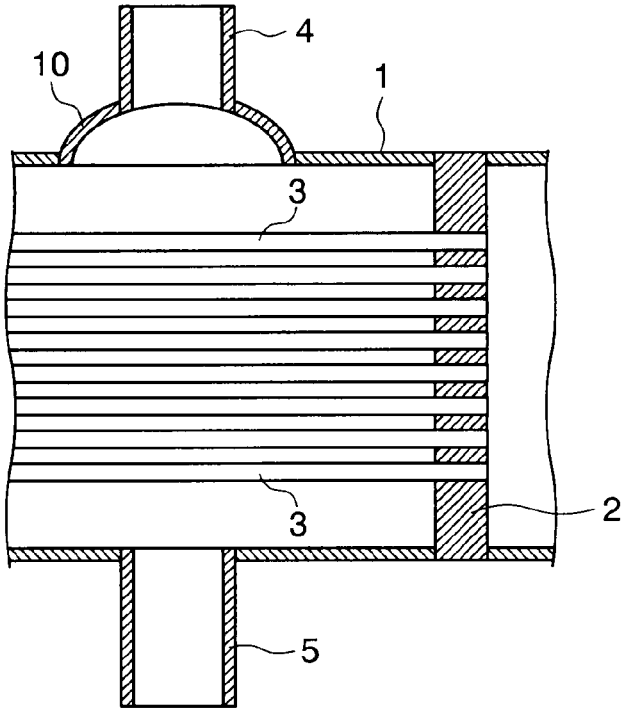
FIG. 3 is a cross-sectional view of a heat exchanger according to a second embodiment of the present invention.

FIG. 3 shows a heat exchanger according to a second embodiment of the present invention. Instead of the cooling jacket 6 of the first embodiment, the second embodiment employs a dome-shaped portion 10 formed on the shell 1.

The dome-shaped portion 10 bulges out of the shell 1 and intervenes between the shell 1 and the high-temperature fluid inlet connection 4.

In the second embodiment, the high-temperature fluid inlet connection 4 is not directly connected to the shell 1, but is separated by the dome-shaped portion 10. This enables reduction of thermal stress as follows.

In comparison of the case where the high-temperature fluid inlet connection 4 is mounted to the dome-shaped portion 10 according to the second embodiment with the conventional case where the high-temperature fluid inlet connection 4 is mounted directly to the shell 1, in the former case the high-temperature fluid inlet connection 4 is mounted to the dome-shaped portion 10 whose diameter is considerably smaller than the diameter of the shell 1. Accordingly, the allowable stress, determined by the calculation of pressure capacity, is higher in the former case according to the second embodiment than in the conventional case.

Further in view of the fact that the dome-shaped portion 10 itself has a high pressure capacity and a high allowable stress, the second embodiment of the present invention is expected to have a higher thermal stress reducing effect compared to the conventional case where the high-temperature fluid inlet seat 4 is mounted directly to the shell 1.

It is possible to use a thermal sleeve structure in the joint between the high-temperature fluid inlet connection 4 and the dome-shaped portion 10. In this case, the thermal sleeve has the effect of reducing thermal stress at the joint between the high-temperature fluid inlet connection 4 and the dome-shaped portion 10 and at the joint between the dome-shaped portion 10 and the shell 1, making it possible to deal with higher temperature conditions.

Figure 4:
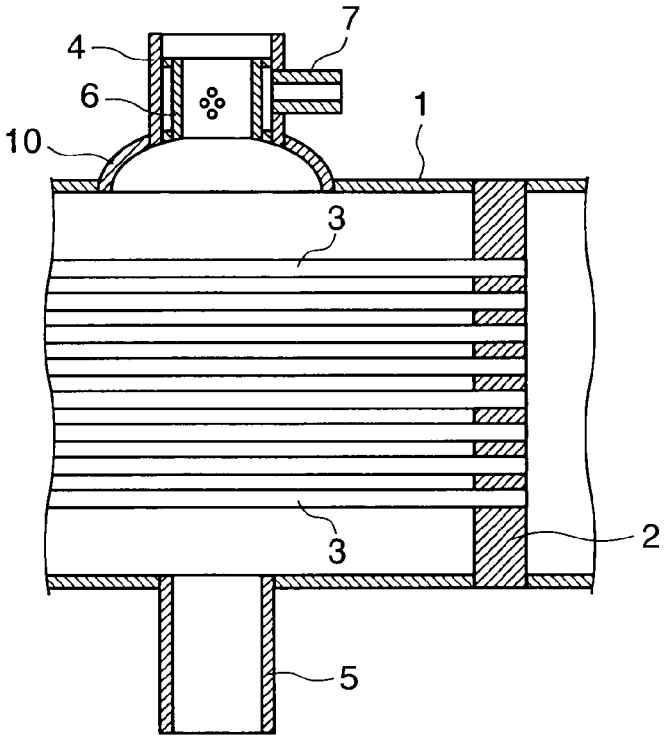
FIG. 4 is a cross-sectional view of a heat exchanger according to a third embodiment of the present invention.

FIG. 4 shows a heat exchanger according to a third embodiment of the present invention. The third embodiment employs the cooling jacket 6 of FIG. 1 and the dome-shaped portion 10 of FIG. 3 in combination. The same reference numerals are used for the same components as in the preceding embodiments, and a detailed description thereof is omitted.

As in the second embodiment shown in FIG. 3, the dome-shaped portion 10 intervenes between the shell 1 and the high-temperature fluid inlet connection 4. As in the first embodiment, the cooling jacket 6 is mounted in the high-temperature fluid inlet connection 4. The cooling fluid inlet port 7 for introducing a cooling fluid into the cooling jacket 6 is mounted to the high-temperature fluid inlet connection 4.

According to this embodiment, thermal stress can be effectively reduced by the synergistic effect of the forced cooling by the cooling jacket 6 and the high allowable stress of the dome-shaped portion 10.

Figure 5:
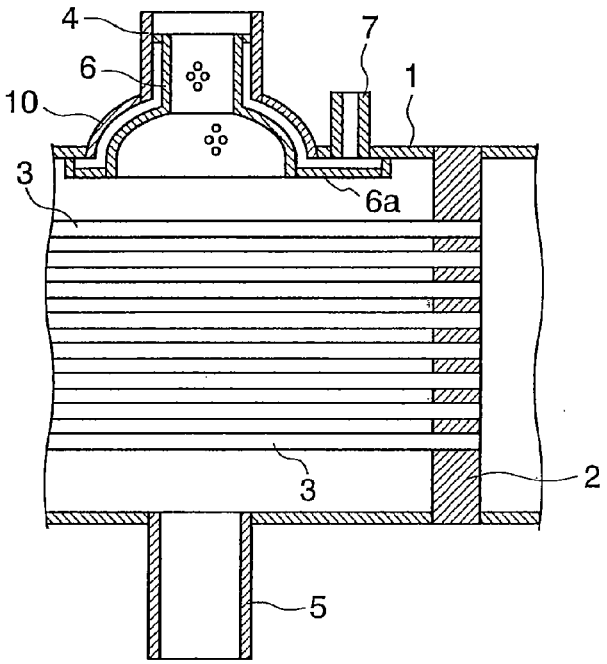
FIG. 5 is a cross-sectional view of a variation of the heat exchanger according to the third embodiment of the present invention.
Figure 6:
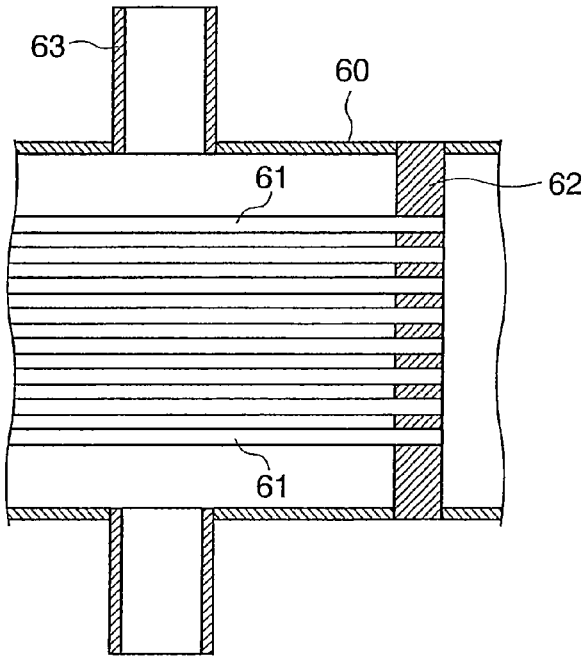
FIG. 6 PRIOR ART
FIG. 6 is a cross-sectional view of a conventional heat exchanger.

FIG. 5 shows an embodiment which corresponds to the combination of the embodiment of FIG. 2 and the embodiment of FIG. 3.

In this embodiment the cooling jacket 6 has a shape conforming to the interior surfaces of the high-temperature fluid inlet connection 4 and the dome-shaped portion 10, and has an extension portion 6*a* extending to the shell 1. The cooling fluid inlet port 7 is mounted to the shell 1.

According to this embodiment, thermal stress can be reduced more effectively by the synergistic effect of the extended forced cooling by the cooling jacket 6 and the high allowable stress of the dome-shaped portion 10.

Though in the embodiments of FIGS. 4 and 5 the cooling fluid is supplied to the cooling jacket 6 from the not-shown cooling pipe, it is also possible to recycle the fluid, whose temperature has been lowered by the heat exchange within the shell 1 and which has been discharged from the shell 1 through the fluid outlet connection 5, to the cooling fluid inlet port 7.

While the embodiments have been described, it will be understood by those skilled in the art that the present invention is not limited to the particular embodiments described above. For example, instead of the dome-shaped portion 10, it is possible to use, for example, a spherical or conical intervening portion insofar as it can achieve separation of a high-temperature area and a low-temperature area.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the sprit of the inventions. The accompanying claims and their equivalents are intended to cover such forms or modifications as would fall within the scope and sprit of the inventions.

What is claimed is:

1. A heat exchanger comprising:

a shell;

a pair of tube plates provided at both ends of the shell;

a plurality of heat transfer tubes supported by the tube plates and housed in the shell;

a high-temperature fluid inlet connection for introducing a high-temperature fluid into a space surrounding outer surfaces of the heat transfer tubes in the shell, the high-temperature fluid inlet connection comprising a body disposed outside of the shell and connected to the shell at a joint between the high-temperature inlet connection and the shell; and a cooling jacket, over which a cooling fluid is to be supplied, is provided on the interior surface of the high-temperature fluid inlet connection, wherein the high-temperature fluid inlet connection and the cooling jacket extend vertically and connect to an upper portion of the shell such that a flow of the high temperature fluid is introduced through the high-temperature fluid inlet connection in a downward flow direction into the upper portion of the shell, and wherein the cooling jacket has a porous structure provided with through-holes that extend through the cooling jacket, the porous structure includes openings provided at more than one location in a direction parallel to the direction of the flow of the high temperature fluid being introduced into the shell through the high-temperature fluid inlet connection.

2. The heat exchanger according to claim 1, wherein a cooling fluid inlet port for introducing the cooling fluid into the cooling jacket is provided in the high-temperature fluid inlet connection.

3. The heat exchanger according to claim 1, wherein the cooling jacket comprises an annular body in the high-temperature fluid inlet connection, and the joint between the shell and the high-temperature fluid inlet connection is provided at an upper portion of the shell.

* * * * *